United States Patent [19]

Smith et al.

[11] Patent Number: 4,676,494

[45] Date of Patent: Jun. 30, 1987

[54] CLOTH SUPPORT AND FEED APPARATUS FOR CLOTH SPREADING MACHINE

[75] Inventors: Hoyt L. Smith; D. Frank Farrah, both of Nashville, Tenn.

[73] Assignee: Cutters Exchange, Inc., Nashville, Tenn.

[21] Appl. No.: 778,900

[22] Filed: Mar. 5, 1984

[51] Int. Cl.[4] ..... B65H 29/46

[52] U.S. Cl. ..... 270/30

[58] Field of Search ..... 270/30, 31; 242/86.5

[56] References Cited

U.S. PATENT DOCUMENTS

| | | | |
|---|---|---|---|
| 2,118,556 | 5/1938 | Haberstump et al. | 270/31 |
| 2,122,674 | 7/1938 | Wardle | 270/31 X |
| 2,276,479 | 3/1942 | Gilbert | 270/31 |
| 2,291,351 | 7/1942 | Scoles et al. | 270/31 |
| 3,468,529 | 9/1969 | Martin, Sr. et al. | 270/31 |
| 3,591,166 | 7/1971 | Ebisu | 270/30 |
| 3,627,301 | 12/1971 | Benson | 270/31 |
| 3,782,649 | 1/1974 | Frederick et al. | 270/31 |
| 4,477,065 | 10/1984 | Smith et al. | 270/31 |
| 4,519,595 | 5/1985 | Adachi | 270/31 |

*Primary Examiner*—E. H. Eickholt

*Attorney, Agent, or Firm*—Harrington A. Lackey

[57] ABSTRACT

A cloth feed apparatus particularly adapted for feeding a heavy cloth roll mounted on a cloth spreading machine. The cloth feed apparatus includes a pair of freely rotatable transverse support rollers in a cloth support frame for supporting substantially the entire weight of a heavy cloth roll transversely of the spreading machine. A cloth feed roller element, in tangential engagement with the outer surface of the cloth roll without supporting any substantial part of the weight of the cloth roll, is driven to feed cloth from the roll. The feed roller element may include a plurality of transversely cleated gripping members and a plurality of transversely spaced belt members entrained about the feed roller element.

The cloth feed apparatus also preferably includes a front dancer roller for controlling the speed of the cloth feed roller element and a rear retainer roller movable betweeen a lower loading position and an upper retaining position, to facilitate loading the cloth roll on the support rollers. The rear retainer roller and the dancer roller may be linked to lock the dancer roller in an upper threading position while the rear retainer roller is in a lower loading position.

15 Claims, 4 Drawing Figures

CLOTH SUPPORT AND FEED APPARATUS FOR CLOTH SPREADING MACHINE

BACKGROUND OF THE INVENTION

This invention relates to a cloth spreading machine, and more particularly to a cloth feed apparatus for a cloth spreading machine.

Various types of cloth feed apparatus have been utilized in the past for supporting and feeding a web of cloth from a cloth roll on a cloth spreading machine, in which the cloth roll is supported upon a cradle of cloth rollers or cloth feed belts, such as illustrated in the following U.S. patents:

U.S. Pat. No. 1,265,452; Isaacs; May 7, 1918

U.S. Pat. No. 2,118,556; Haberstump et al.; May 24, 1938

U.S. Pat. No. 2,276,479; Gilbert; Mar. 17, 1942

U.S. Pat. No. 3,412,950; Martin, Sr.; Nov. 26, 1968

In the Martin, Sr. U.S. Pat. No. 3,412,950, a pair of parallel fluted rollers support a cloth roll and are adapted to be driven to feed a web of cloth from the cloth roll supported by the rollers. The circumferentially spaced alternating ribs and depressions in the fluted rollers accumulate slack created by the weight of the roll engaging the rollers, and the web fed from the roll is less wrinkled when spread upon the cutting table.

However, it has been found that when the cloth roll is excessively heavy, the fluted rolls which both support and feed the web of cloth from a cloth roll cannot overcome the excess slack generated from such a heavy roll.

The problem of smoothly feeding a web of cloth from an excessively heavy roll was solved in the Martin, Sr. U.S. Pat. No. 3,394,897, issued July 30, 1968, in which the spindle extending through the core of the cloth roll was suspended by a motor-controlled chain mechanism and gradually lowered into engagement with a pair of feeding rollers.

However, the size of cloth rolls handled by cloth spreading machines are becoming larger and heavier in the garment industry. Some cloth rolls are so large and heavy that the spindles extending through their core bend and are severely strained when the cloth roll is supported solely by the spindle. Such heavy cloth rolls are more effectively supported upon the cradle-type rollers.

However, even though such heavy cloth rolls may be satisfactorily supported upon cradle-type rollers, nevertheless, utilizing the same rollers to both support and feed the heavier cloth rolls presents problems in controlling the slack and wrinkles in the web of cloth laid upon the spreading or cutting table in a cloth spreading operation.

SUMMARY OF THE INVENTION

It is therefore an object of this invention to provide in a cloth spreading machine a cloth support and feed apparatus particularly adapted for feeding a web of cloth from a very heavy cloth roll satisfactorily with a minimum amount of slack or wrinkles when laid upon the cutting table.

The cloth feed apparatus made in accordance with this invention includes a pair of freely rotatable parallel support rollers for supporting substantially the entire weight of the cloth roll and a separate rotatable cloth feed element engaging the feed roll sufficiently for rotating the cloth roll on the support rollers and feeding the cloth from the roll, but without bearing any substantial portion of the weight of the cloth roll.

The rotatable cloth feed element preferably takes the form of a driven cloth feed roll having a plurality of transversely spaced annular gripping members including circumferentially spaced cleats or ribs for firmly gripping the outer surface of the cloth roll and feeding a web of cloth from the roll.

Preferably, the cloth feed element also includes a plurality of front and rear feed belts all of which are entrained about the cloth feed roller, spaced transversely apart and projecting forward and rearwardly of the cloth feed roller and in tangential engagement with the cloth roll. Also preferably the front feed belts pass around the front support roller and the rear belts pass around the rear support roller so that the support rollers which bear the weight of the cloth roll also support the feed belts and hold the belts in continuous engagement with the outer surface of the cloth roll.

The cloth feed apparatus made in accordance with this invention also contemplates a movable rear retainer roller for assisting in holding the cloth roll in its operative position on the support rollers while the retainer roller is in an upright retaining position. When the retainer roller is in a lowered, loading position, loading of the cloth roll into its operative position upon the support rollers is facilitated. The rear retainer roller is preferably linked with a dancer roller in front of the cloth roll for monitoring the slack in the web fed from the cloth roll and for controlling the speed of the cloth feed roller. The linkage between the dancer roller and the rear retainer roller permits the dancer roller to be locked in an elevated threading position while the rear retainer roller is in a lowered loaded position.

DESCRIPTION OF THE PREFERRED EMBODIMENTS

Figure 1:
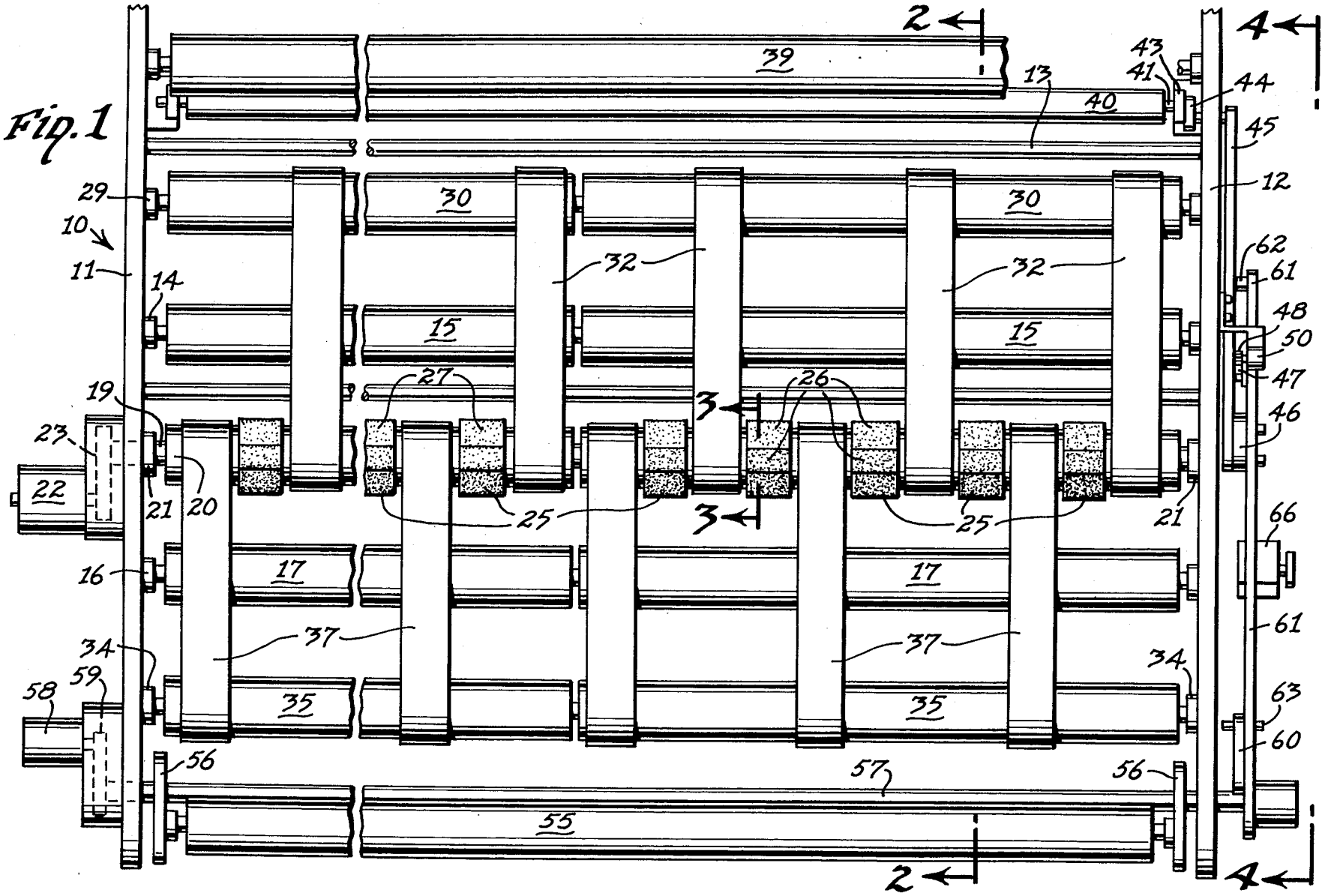
FIG. 1 is a top plan view of the cloth feed apparatus made in accordance with this invention.
Figure 2:
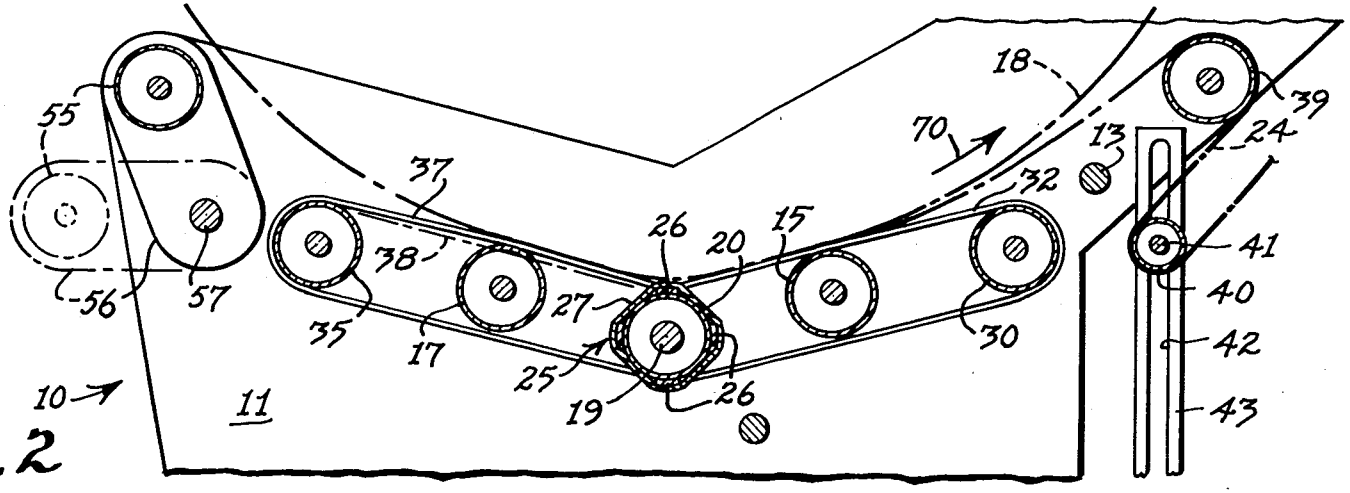
FIG. 2 is an enlarged side sectional elevation of the cloth feed apparatus, with a cloth roll shown in operative position, and taken along the line 2—2 of FIG. 1.
Figure 3:
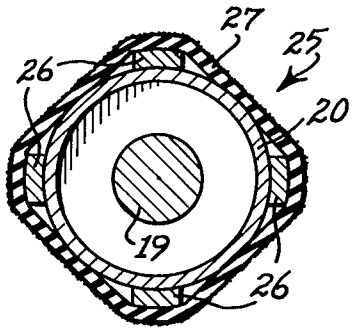
FIG. 3 is an enlarged section taken along the line 3—3 of FIG. 2, disclosing the construction of an annular gripping member.

Referring now to the drawings in more detail, FIGS. 1 and 2 disclose a cloth roll support frame 10, adapted to be mounted on a cloth spreading machine and having a pair of parallel side walls or plates 11 and 12 secured together and spaced apart by appropriate spacer rods, such as the spacer rod 13.

Freely rotatably journaled in bearings 14 mounted on the side walls 11 and 12 is a front support roller 15. Likewise journaled in bearings 16 in the side walls 11 and 12 for free rotatable motion is a rear support roller 17. The support rollers 15 and 17 are both mounted to extend transversely of the frame 10 and parallel to each other. The support rollers 15 and 17 are spaced apart a distance substantially less than the diameter of a cloth roll or supply roll 18 and are adapted to support substantially the entire weight of the cloth roll 18.

Journaled in bearings 21 in the side walls 11 and 12 is an elongated transverse feed shaft 19 supporting a cloth feed roller 20 parallel to and preferably midway between, the support rollers 15 and 17. The feed shaft 19 is driven from a cloth feed motor 22 through a transmission 23, which can be in the form of a gear reducer or a chain and sprocket speed reducing mechanism, mounted on the side wall 11 (FIG. 1). The cloth feed motor 22 may be reversible in order to wind or unwind the cloth web 24 from the supply roll 18.

Spaced axially along the feed roller 20, and transversely of the frame 10 are a plurality of annular gripping members 25. Each annular gripping member 25 includes a plurality (4 in the drawings) elongated cleats 26 circumferentially spaced about the periphery of the cloth feed roll 20. Furthermore, the cleats 26 may be encompassed by an annular band of gripping material 27 having a peripheral surface of a high co-efficient of friction, such as knurled or embossed rubber or plastic band material. On a cloth feed roller 20 having a 3" diameter, each cleat 26 may project approximately ¼ of an inch from the periphery of the feed roller 20. The circumferential spacing between the cleats 26 on each gripping member 25 is sufficient to accumulate slack portions of the cloth roll 18.

Journaled in bearings 29 in the side walls 11 and 12 in front of the front support roller 15 is a front belt roller 30. The front belt roller 30 is in general planar alignment with the cloth feed roller 20 and the front support roller 15. Trained around the cloth feed roller 20 and the front belt roller 30 are a plurality of transversely spaced front endless feed belts 32. The front feed belts 32 also pass around the intermediate front support roller 15.

Journaled in the bearings 34 on the side walls 11 and 12 to the rear of the rear support roller 17 is a rear belt roller 35. Trained about the cloth feed roller 20 and the rear belt roller 35 and spaced transversely between the front feed belts 32 and the annular gripping members 25, are a plurality of transversely spaced endless rear feed belts 37. The rear feed belts 37 also pass around the rear support roller 17.

Although the support rollers 15 and 17 are contained within the respective feed belts 32 and 37 and are in general co-planar alignment with the respective belt rollers 30 and 35 and the cloth feed roller 20, nevertheless each of the support rollers 15 and 17 is preferably located slightly above the respective belt planes. For example, in FIG. 2, the top surface of the rear support roller 17 extends above the tangential plane 38 of the top surfaces of the cloth feed roller 20 and the rear belt roller 35, so that the support roller 17 carries the top leg of the rear belt 37 slightly above the normal tangential belt plane 38. The main reason for this slight elevation of the support rollers 15 and 17 is to permit only the support rollers 15 and 17 to bear substantially all of the weight of the cloth roll 18. As indicated in FIG. 2, neither the front belt roller 30 nor the rear belt roller 35 are touching the bottom surface of the cloth roll 18. Even if the cloth roll 18 were not tightly wound, or the cloth roll 18 were larger, and the bottom surface of the cloth roll 18 were actually touching the belt rollers 30 and/or 35, nevertheless, neither the belt rollers 30 or 35 would sustain much, if any of the weight of the cloth roll 18.

In like manner, the cloth feed roller 20 is only in sufficient tangential engagement with the bottom surface of the cloth roll 18 to permit the cleats 26, the frictional annular bands 27, and the endless front and rear belts 32 and 37, to engage the outer bottom surface of the cloth roll 18 to rotate the cloth roll 18 without bearing a significant portion of the weight of the cloth roll 18. The support rollers 15 and 17 may be adjustable in directions perpendicular to the tangential plane 38 in order to be moved radially toward or away from the cloth roll 18 so that the support rollers 15 and 17 will support the maximum, or substantially the entire, weight of the particular cloth roll 18 mounted in the frame 10.

As disclosed in FIGS. 1 and 2, only the cloth feed roller 20 is driven to rotate the cloth feed roll 18 in the direction of the arrow 70 to feed the cloth web 24 about a top front idler roller 39 and beneath a dancer roller 40. The dancer roller shaft 41 freely moves vertically in vertical slots 42 in a pair of standard 43 on the support frame 10.

Figure 4:
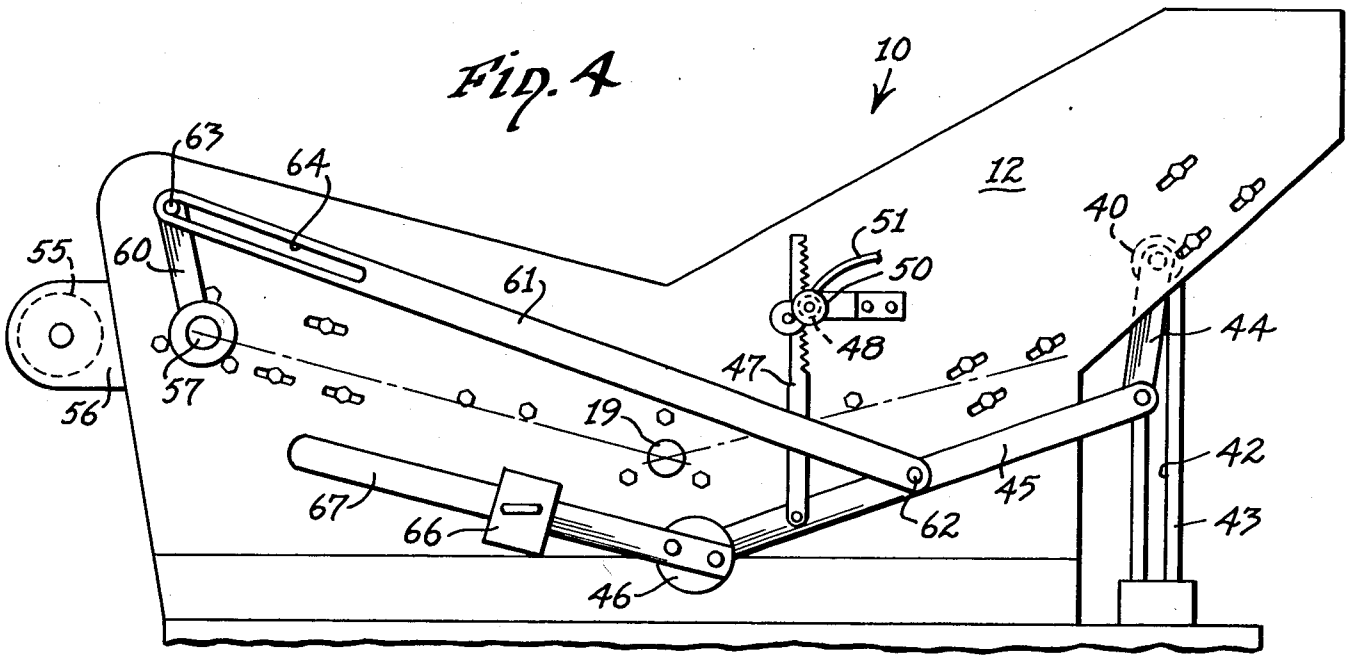
FIG. 4 is a side elevational view taken along the line 4—4 of FIG. 2, illustrating the linkage between the dancer roller and the rear retainer roller.

As best disclosed in FIG. 4, the dancer roller 40 is pivotally linked by a connecting arm 44 to a lever arm 45 pivotally mounted about the bearing 46. Pivotally mounted to the lever arm 45 and extending upward, is a rack member 47 engaging a rotary gear 48, in hidden lines, on a rotary potentiometer 50 which is electrically connected through the conductor 51 to the cloth feed motor 22. Thus, the dancer roller 40 senses the slack in the cloth web 24 and through its linkage to the potentiometer 50 controls the speed of the feed of the cloth roll 18. Thus, the cloth web 24 is spread at a speed commensurate with the speed of the cloth spreading machine supporting the frame 10 along a cutting table, not shown.

As best disclosed in FIGS. 2 and 4, a rear retainer roller 55 is journaled between a pair of pivot arms 56, the lower ends of which are fixed to a pivot shaft 57 journaled in the opposite side walls 11 and 12. The pivot shaft 57 may be driven by an electrical motor 58 through a transmission 59 (FIG. 1). When the shaft 57 is driven so that the rear retainer roller 55 is in its uppermost solid-line position disclosed in FIG. 1, the cloth roll 18, supported in its operative position upon the support rollers 15 and 17, is prevented from inadvertently rolling rearwardly out of the frame 10. When the pivot shaft 57 is driven so that the rear retainer roller 55 is in a lower loading position, as illustrated in phantom in FIG. 2, the cloth roll 18 may be easily loaded or rolled over the rear retainer roller 55 into its operative position upon the support rollers 15 and 17.

Preferably, the pivot shaft 57 is provided with a connecting arm 60 to a long link bar 61 pivotally connected by pin 62 to the lever arm 45 connected to the dancer roller 40. The connection between the connecting arm 60 and the link bar 61 is provided by a pin or lug 63 received within an elongated slot 64 in the link bar 61. Thus, as disclosed in FIG. 4, when the rear retainer roller 55 is in its lower loading position, the lug 63 is in its extreme rearward position within the slot 64 to prevent any forward movement of the link bar 61, which in turn retains the dancer roller 40 in an elevated locked position to facilitate the threading of a cloth web 24, while a cloth roll 18 is being loaded over the rear retainer roller 55.

When the cloth roll 18 is loaded in the frame 10 and the pivot shaft 57 is driven to move the rear retainer roller 55 to its upper retaining position, the lug 63 moves forward in the slot 64 to permit the dancer roller 40 to freely rise and fall with the slack developed in the sensed portion of the cloth web 24. The weight of the retainer roller 55 may be counterbalanced with the counter-weight 66 adjustably supported on the arm 67 fixed to the bearing 46.

It will therefore be seen that a cloth feeding apparatus has been developed which will adequately support and feed a web from an extremely heavy cloth roll, substantially free of slack or wrinkles in the web 24 which is laid upon the cutting table in a cloth spreading operation. Cloth rolls of approximately 1,400 pounds have been successfully spread without wrinkles in the spread layers, with a cloth support and feed apparatus made in accordance with this invention.

Because of the location of the idler support rollers 15 and 17, the heavy weight of the cloth roll 18 is relieved from the cloth feeding mechanism, namely the cloth feed roll 20, the cleats 26, frictional bands 27 and the feed belts 32 and 37.

Not only is the cloth feeding function enhanced by the traction of the rough frictional surface of the annular bands 27, the radial projection of the cleats 26, and the large surface area of the front and rear belts 32 and 37, but the circumferential spaces between the cleats 26 permit the accumulation of any slack developed by the mass of the cloth roll 18 sagging between the idler support rollers 15 and 17. The feed belts 32 and 37 also distribute the feeding traction created by the cloth feed roll to a larger area of the outside surface of the cloth roll 18.

Even though portions of the belts 32 and 37 are pinched between the idler support rollers 15 and 17 and the contiguous portions of the cloth roll 18, nevertheless, little drag is created upon the feed shaft 19, because of the minimum contact between the idler rollers 15 and 17 and the feed belts 32 and 37, and also because the support rollers 15 and 17 are free to rotate in response to the pull of the respective belts driven from the cloth feed roll 20.

What is claimed is:

1. In a cloth spreading machine including an elongated machine frame movable longitudinally reciprocably over a spreading table, a cloth feed apparatus comprising:

(a) a cloth roll support frame having a longitudinal feed axis, and opposite ends, (b) a pair non-driven support rollers for supporting a cloth roll, (c) first bearing means journaling said support rollers for free rotation in said support frame and to extend parallel to each other and transversely of said longitudinal feed axis, (d) said support rollers being spaced apart longitudinally to support substantially the entire weight of a cloth roll parallel to and upon said support rollers in operative position, (e) a feed roller element having a cloth feed surface, (f) second bearing means journaling said feed roller element in said support frame to extend parallel to said support rollers, so that said cloth feed surface frictionally engages the outer surface of the cloth roll in operative position to feed the outer surface of the cloth roll without bearing a significant portion of the weight of the cloth roll, and (g) drive means operatively connected to said feed roller element to positively rotate said feed roller element in the direction of said feed axis.

2. The invention according to claim 1 in which said feed roller element comprises an elongated feed roller extending transversely of said support frame and said cloth feed surface comprises a plurality of cleats spaced circumferentially around said feed roller, said cleats being in substantial tangential engagement with the outer surface of the cloth roll in operative position for rotating the cloth roll upon said support rollers.

3. The invention according to claim 1 in which said second bearing means journals said feed roller element between and beneath said pair of support rollers.

4. The invention according to claim 3 in which said feed roller element comprises an elongated feed roller extending transversely of said support frame, said cloth feed surface comprises a plurality of feed belts trained about said feed roller and extending in said feed direction in tangential feeding engagement with the outer surface of a cloth roll in operative position.

5. The invention according to claim 4 further comprising a plurality of said feed belts trained about said feed roller, said feed belts being transversely spaced apart along said feed roller.

6. The invention according to claim 5 in which said feed belts comprise first feed belts extending longitudinally toward one end of said support frame and second transversely spaced feed belts extending toward the opposite end of said support frame.

7. The invention according to claim 6 in which said cloth feed surface further comprises a plurality of annular gripping members, each comprising a plurality of circumferentially spaced cleats, said annular gripping members being transversely spaced along said feed roller.

8. The invention according to claim 7 in which each of said annular gripping members is located between a pair of said feed belts.

9. The invention according to claim 6 further comprising an elongated first belt roller and means journaling said first belt roller adjacent one end of said support frame for entraining said first feed belts, and a second belt roller and means journaling said second belt roller transversely of said frame adjacent the other end of said support frame and entraining said second feed belts, said pair of support rollers comprising a first support roller extending transversely through said first feed belts and between said feed roller and said first belt roller, and a second support roller extending transversely through said second feed belts between said feed roller and said second belt roller.

10. The invention according to claim 1 further comprising an elongated retainer roller extending transversely adjacent the second end of said support frame, an elongated pivot shaft extending transversely of said support frame parallel and adjacent to said retainer roller, and pivot arms having upper and lower ends, said upper ends being journaled to the opposite ends of said retainer roller and said lower ends being fixed to said pivot shaft, and means for rotating said pivot shaft to swing said retainer roller between an upper operative position behind the cloth roll in said operative position, and a lower loading position to facilitate the loading of a cloth roll over said retainer roller upon said support rollers.

11. The invention according to claim 10 further comprising an elongated dancer roller extending transversely of said support frame adjacent said first end of said support frame, means operatively connecting said dancer roller to said drive means whereby the movement of said dancer roller in response to a slack loop of cloth from the cloth roll around said dancer roller controls the speed of said drive means.

12. The invention according to claim 11 further comprising link means connecting said dancer roller to said retainer roller pivot shaft, whereby when said retainer roller is in said loading position, said dancer roller is in an elevated locked stationary position, and when said retainer roller is in said upright operative position, said dancer roller is free to move in response to the slack in the cloth sensed by said dancer roller.

13. The invention according to claim 12 in which said link means comprises an elongated link bar having an elongated slot adjacent said pivot shaft, an arm projecting radially from said pivot shaft and having a stud slideably mounted in said slot, said link bar having a first end operatively connected to said dancer roller for movement therewith, said stud engaging the rear end of the slot in said link bar when said retainer roller is in said loading position whereby said link bar and said dancer roller are locked in said elevated position, said stud moving to an intermediate position in the slot in said link bar when said retainer roller is in said upright position to permit free movement of said dancer roller.

14. The invention according to claim 13 in which said link means operatively connects said dancer roller to said drive means.

15. The invention according to claim 14 in which said drive means for said feed roller comprises an electrical motor for rotating said feed roller and further comprising a potentiometer electrically connected to said drive means for varying the speed of said motor, said link means comprising rack and gear means coupling said dancer roller to said potentiometer whereby movement of said dancer roller causes said rack and gear means to change the resistance in said potentiometer.

* * * * *